US010210703B2

(12) United States Patent
Merati

(10) Patent No.: US 10,210,703 B2
(45) Date of Patent: Feb. 19, 2019

(54) MULTI-JURISDICTIONAL ODDS AND RISK MANAGEMENT SYSTEM

(71) Applicant: UPLAY1, San Diego, CA (US)

(72) Inventor: Bruce Merati, San Diego, CA (US)

(73) Assignee: Uplay1, Las Vegas, NV (US)

( * ) Notice: Subject to any disclaimer, the term of this patent is extended or adjusted under 35 U.S.C. 154(b) by 0 days.

(21) Appl. No.: 15/436,600

(22) Filed: Feb. 17, 2017

(65) Prior Publication Data

US 2017/0243438 A1 Aug. 24, 2017

Related U.S. Application Data

(60) Provisional application No. 62/299,299, filed on Feb. 24, 2016.

(51) Int. Cl.
*G07F 17/32* (2006.01)

(52) U.S. Cl.
CPC ..... *G07F 17/3237* (2013.01); *G07F 17/323* (2013.01); *G07F 17/3223* (2013.01); *G07F 17/3288* (2013.01)

(58) Field of Classification Search
None
See application file for complete search history.

(56) References Cited

U.S. PATENT DOCUMENTS

| | | | | |
|---|---|---|---|---|
| 7,566,270 | B2 * | 7/2009 | Amaitis | G07F 17/3288 463/16 |
| 9,758,108 | B2 * | 9/2017 | Hirakawa | B60R 13/02 |
| 2005/0197939 | A1 * | 9/2005 | Davie | G06Q 40/00 705/35 |
| 2015/0154827 | A1 * | 6/2015 | Arnone | G07F 17/3244 463/25 |
| 2016/0035188 | A1 * | 2/2016 | Arnone | G07F 17/3244 463/25 |

* cited by examiner

*Primary Examiner* — Ronald Laneau
(74) *Attorney, Agent, or Firm* — Thibault Patent Group

(57) ABSTRACT

Various embodiments of a multi-jurisdictional wagering system are described for preforming actions to increase the diversity, volume and efficiency of a regulated wagering market. In one embodiment, the odds offered by an odds maker are distributed via a licensed disseminator to entities who are licensed to take wagers form punters within a regulated jurisdiction. In another embodiment, a system and method is described for a licensed entity to receive a guaranteed fee for offering wagering opportunities to punters, minimizing the financial exposures to the licensed entity for offering the wagering opportunities. In yet another embodiment, a hybrid wagering system is described that combines fixed odds wagering within a pari-mutuel framework.

16 Claims, 5 Drawing Sheets

MULTI-JURISDICTIONAL ODDS AND RISK MANAGEMENT SYSTEM

CROSS-REFERENCE TO RELATED APPLICATIONS

This application claims the benefit of U.S. provisional patent application No. 62/299,299, filed on Feb. 24, 2016 and incorporated by reference herein.

BACKGROUND

I. Field of Use

The present application relates generally to wagering, and more specifically to a system and method for providing pre-match and in-match sports wagering.

II. Description of the Related Art

Sports wagering is a growing industry throughout the world and, in most jurisdictions, is subject to strict laws. In the case of the United States, both state and federal law govern all aspects of gambling and wagering activities. In the last twenty years, placing wagers on the outcome of sporting activities has been on a steady rise in both the U.S. and other parts of the world. Most European countries historically have been more liberal towards wagering and have allowed bookmakers legally to take wagers on the outcome of almost any future event such as a sports match, a presidential election, a winner of a movie award or other scenarios where there is more than one possible outcome or the outcome is less than certain.

In the United States, Nevada is currently the only state that allows a full range of sports wagering. Delaware is another state that has recently allowed most, but not all types of wagering. Delaware currently does not allow straight wagers, commonly called a head-to-head wager, where the outcome is based on a single game. Oregon and Montana also have some Federal exemptions and allow small stake sports wagering. Recently, Nevada regulators have allowed licensed bookmakers to also take bets on non-sporting events. With sports wagering outlawed in other states, sport enthusiasts in the U.S. have no option but to place wagers through illegal bookmakers (bookies) or offshore websites. Illegal bookmaking from U.S. residents has been a growing and thriving business for illicit operators. The American Gaming Association estimates U.S. citizens illegally wagered $149 billion on sports in 2015 through offshore betting websites and illegal bookmakers.

With the growth and popularity of the Internet, boosted by mobile devices and wireless broadband, as well as expansion of video streaming, betting on offshore sports wagering sites has been growing rapidly, forcing the U.S. Department of Justice and the state officials to enact new laws to combat illegal wagering. Enforcement of these laws however, has proven to be a very difficult task and, every time the U.S. government has passed a new law, offshore operators have introduced a new strategy that has made the law enforcement difficult. Historically, most types of gaming in the U.S. have been conducted through land-based venues owned and managed by licensed gaming establishments who initially opposed online gaming. Some land-based casinos have reversed their positions and led the charge in 2013 that resulted in legalization of online gaming in Nevada, Delware and New Jersey. The U.S. laws treat wagering, gaming and lotteries very differently, even though they are all a form of gambling. Despite the legalization of Internet gaming by the state of New Jersey, the Federal laws prevail over the state's online gaming laws, making sports wagering illegal in the state even though almost any type of gaming is legal online within the state.

The Interstate Wire Act of 1961 prohibits the operation of certain types of betting operations in the United States. The Wire Act together with other federal bookmaking statutes was intended to assist the states and other jurisdictions in the U.S. to enforce their respective laws on gambling and bookmaking. For the past three years, the state of New Jersey has been trying to legalize sports betting to give a boost to Atlantic City's casinos and the state's horseracing industry, both of which have been struggling financially. As of now, New Jersey's efforts to legalize sports wagering has hit resistance from both the courts and certain sports leagues, such as the NFL.

Lately, wagering on daily fantasy sports has proven to be a thriving business, attracting the attention of regulators at both the federal and state levels. Daily fantasy sports ("DFS") are a version of traditional fantasy sports that are conducted over a short period of time, such as a week or on a single day of competition, as opposed to the traditional fantasy sports, which are played across an entire season. The popularity of DFS has shown that sport enthusiasts are much more interested in a short contest, which is more like a traditional sports wagering than a contest spanning over a long period such as a season.

The premise behind fantasy sports is for game participants to pay an entry fee to enter into a contest and put together the best virtual or fantasy team of players that achieves the highest fantasy points, with each player being assigned a certain amount of salary. The combined salaries of all the team must stay under a certain cap. There are some who argue such a contest is a skill-based game, thus exempting such games from U.S. wagering laws, and there are those who argue differently. Some of the major networks, sporting team owners and professional leagues have recently invested hundreds of millions of dollars in FanDuel and DraftKings, two of the biggest DFS companies who started heavily advertising on TV and other media, until the attorney general of some states such as Nevada and New York accused DFS as being unlawful, unless they were licensed or regulated by their states. The recent popularity of DFS has proven that sports fans in the U.S. are looking to express their opinions about sports wagering and how players will perform in a game or a series of games.

In Europe, live wagering during a game, sometimes called In-game, In-wagering or InPlay, has been growing exponentially. InPlay wagers are placed on an event, match, or race while the event is still in progress. A bookmaker often tasks a bet trader to watch a game live and create time sensitive InPlay wagering odds during the game. InPlay wagers fulfill the urge for interactivity and instant gratification, an entertainment experience that appeals to the phycology of most millennials who have grown up playing interactive video games and now represents a large percentage of the population legally allowed to wager on sporting events. The goal of the trader is to offer InPlay odds that appeal to a wide range of viewers, get them engaged to feel they are part of the game, split their opinions through odds offered and to entice bets on both sides of the proposition. If an odds maker's book gets out of balance, it immediately tries to balance its books by offering new odds in an attempt to bring more bets on the other side to minimize its exposure to the outcome of the event.

Live odds are offered in real time before the event finishes. For example, in tennis, punters can bet on total games played in a set, a set's score. In soccer or football, they can bet on the half time results or on the next team to score. Availability of smart phones has made InPlay wagering extremely convenient for viewers to watch a sport live and place wagers while the game is in progress in a new phenomenon that is called second-screen wagering. Globalization, new social media, ubiquity of the Internet, smart phones, computer tablets and availability of live sports on TV and HD video streaming, has made sports wagering increasingly more popular with sport enthusiast around the globe who would like to root for their favorite teams and athletes by placing wagers before and during the game.

In Europe, InPlay wagering is increasing becoming a bigger percentage of the total wagering handles of a bookmaker, proving that people prefer to place a wager while the game is in progress. Also, social media sites have started competing with each other by entering into the excitement of watching sports. By adding new features to their sites, they make watching live games more social. For example, Facebook is rolling out a new live feed, called Sports Stadium, that gives people another way to follow sporting events and chat about them as they happen. The feed combines what people already check Twitter and ESPN for during the games and shifts that second-screen experience from those properties to Facebook. The more people are engaged in watching a live sport, the more opportunity exists for InPlay wagers.

In Europe and other parts of the world, betting exchanges are also becoming increasingly more popular, with punters wagering against each other rather than placing a wager with a bookmaker, who for facilitating the wager, takes a fee commonly called juice or vig, short for vigorish. To compete with betting exchanges, some traditional bookmakers in Europe have been forced to reduce their fees. The competition between bookmakers as the middlemen and the Internet betting exchanges, that effectively eliminates the middlemen, has created lower fees but higher handles in jurisdictions that do not treat sports wagering as an illegal activity. In highly regulated jurisdictions such as the state of Nevada, due to strict regulations, operators have been slow in taking advantage of new technologies, and the competition and pressure of wagering fees has not been as fierce as in Europe.

Another new phenomenon in wagering is betting on a stock or a financial market. These wagers are usually based on a value associated with a financial market, giving punters the opportunity to bet on whether a financial market or a stock value will be above or below a moving line at a designated time. The wager is then settled after the designated time to resolve whether the user is entitled to a credit or a debit. Some jurisdictions are taking the position that an operator taking wagers on stocks and financial instruments needs to have a securities license and some jurisdictions consider such activities purely as a wagering activity.

Politics, tax revenues, consumer protection and game integrity are some of the reasons behind various interest groups arguing as to whether a state should legalize sports wagering. As an example, the NFL is opposed to sports wagering, arguing that it may incentivize players and referees to fix game outcomes. This position, however, is flawed, and is in contrast with the NFL's push to have more and more of its games played in London, where wagering is legal and very common. Also another contradictory factor is that the volume of wagers that illegal offshore websites are currently taking on U.S. games such as football are much larger than Nevada's handles. Moreover, the chances of unregulated offshore operators fixing a game are higher than operators who are regulated and licensed by a state.

Wagering is already a multi-billion dollar industry in most European, Asian and North American countries and has the potential to be an even bigger business. By offering odds that appeal to both sides of a wager, a bookmaker's goal is to split people's opinion in half to balance its books or minimize its exposure to the outcome of the event. In exchange for facilitating the process, a bookmaker collects a fee from the winning side, which is typically about 5% percent of total amount wagered in a pre-match wager and 10% on an InPlay wager. Typically, the bookmaking business starts with one or more leading odds makers setting up the initial lines using detailed data, statistics and historical information about the players and the teams. Once a leading book adopts the odds, other books then start offering them as the basis for their starting lines. Odds offered before a game are called pre-match lines, which often change based on the volume of wagers placed on each side of the wager. Illegal bookies that do not have liquidity often lay off their pre-match exposures by placing wagers with Nevada books or international betting exchanges.

Nevada operators also offer long shot odds such as whether the first score of a football game will be a safety, or whether a quarterback will throw a touchdown or interception on the next play, etc. These types of wagers are called proposition bets or "prop bets" and have high risk and rewards for a bookmaker. The goal of an experienced bookmaker, by offering prop bets, is to tantalize bettors with promises of big payoffs. Unlike point spreads and money lines, prop bets can vary wildly from sports book to sports book. To overcome the volatility inherent with prop bets, bookmakers often offer hundreds of prop bets to average out the risk and rewards associated with these types of risky wagers. For popular games such as football, basketball and baseball, an average fan may bet on four or five prop bets along with only one traditional point spread.

Sometimes, professional handicappers, called "wise guys", who make a living from betting against a sports book cause a book to change its lines. There are also those who arbitrage by placing wagers with different books when they see the lines from different operators. This provides an opportunity to make a profit with little or no risk. Online betting and availability of data has helped experienced arbitragers to increase their chances of making a profit from the inefficiencies of a sports wagering market. Once a game starts, pre-match odds are no longer offered and bookmakers encourage punters to bet on InPlay wagers.

Currently, sport enthusiasts in the U.S. are prohibited or are limited to the type of wagers they can place. A U.S. resident must either bet with a sports book in a state such as Nevada or bet with local illegal bookies or on offshore websites. Most of what is currently offered in Nevada and Delaware are pre-match odds with very little InPlay odds offered by Nevada sports books. Typically Nevada books only offer pre-match odds for popular U.S. games such as football, basketball, baseball and hockey. Regulations and licensing has kept Nevada books isolated from the international wagering market. Also, due to lack of adequate player participation within the state, most often Nevada books do not offer a comprehensive set of odds on non-U.S. games even if they are worldwide events, such as the Olympics, the World Cup and the Grand Slam Tennis.

Historically, sports wagering in Nevada has been a B2C business model with the wagering license being attached to a casino's property. Smaller casinos often lease a space inside their casinos to a licensed operator to run the sports book on their behalf. The main reason for the lack of technology interaction and connectivity between Nevada operators has been lack of open competition from outside of the state. The high upfront cost of investigation for an outside entity to get licensed as a sports book operator within the state, in comparison to the potential business opportunities that the state currently offers, has prevented most international sports books from entering into the Nevada market. Nevada operators have traditionally been risk averse—after they set up initial lines, they often move the lines to avoid financial risks associated with the outcome of the event. Traditionally the term "book" refers to any system, computerized or manual, that tracks wagers and payouts of a wager broker. A book may refer to a single wagering event, such as a particular sporting event or globally to all wagering events offered by a wagering entity, such as a casino, online establishment, etc. Some Nevada casinos that are owned by a major gaming company run their own books, with smaller casinos often leasing their license to a sports wagering operator. Currently, Nevada casinos have not developed a cooperative market or an exchange for a more robust and efficient market for wagering activities.

In Nevada and Europe, wagering traditionally has been based on fixed odds. On a pre-match wager, a punter normally has to risk $11 to win $10. As an example, if an NFL team A is favored to win against team B by 10 points, books give the weaker team a handicap point or, alternatively, deduct the handicap point from the stronger team. In the above example, a book may display a −10 next to team A to show it is the favorite to win by 10 points against team B or may display a +10 next to team B to show it is underdog by 10 points. Assuming the book has a balanced book, i.e. for every $11 wagered on team A, exactly the same amount is also wagered on team B, then for every $22 wagered, the book will pay $21 to the winner which is the original $11 wager plus a $10 win, with the book keeping $1 as its fee. By dividing the $1 fee by the $22 total amount wagered, the theoretical house edge or commission for the house is calculated to be 4.545%.

Conventionally, only horse racing has been offered in a pari-mutuel format with the house having no risk to the outcome of a race. The main appeal of fixed odds to punters is that they know how much they can win when they place their wagers. However, for an operator, fixed odds wagering is oftentimes a very risky business. The major sports books in the U.S. and Europe are public companies, which by their nature of having public stockholders who expect results that are better than previous periods, have to avoid large risks. Currently, books, large or small, typically shy away from large bets if they do not have enough wager liquidity for the event. As online sports wagering is becoming a global business and punters can place wagers in any part of the world with a click of a button, there is a need to process large amounts of wagers and address the main obstacle inherent in the business, i.e. addressing risk when there is low liquidity of wagers.

Two sports wagering laws passed by Nevada legislators in 2015 will have a major impact on the state's traditional wagering business. One of the bills authorizes financiers to invest in a "wagering entity" registered by the state to take risks on sporting events, and the other bill allows Nevada books to operate in other regulated markets. The purpose behind these bills is to provide more liquidity and more sports betting opportunities between Nevada and other jurisdictions, especially by those who are operating in European countries. The new laws will expand Nevada's wagering activities beyond the state's current traditional wagering and will allow professional handicappers, i.e. those who analyze historical data to better predict the odds of an event, to manage the monies of investors taking risks on sports wagering. The investment made in these entities can take risks on fixed odds wagers that have guaranteed payouts, pari-mutuel wagering or other gaming formats that are currently used in the gaming industry.

SUMMARY

Various embodiments of a multi-jurisdictional wagering system are described for preforming one or more actions to increase the diversity, volume and efficiency of a regulated wagering market. In one embodiment, the odds offered by an odds maker is distributed and processed via a licensed disseminator to entities who are licensed to take wagers form punters within a regulated jurisdiction. In another embodiment, a system and method is described for a licensed entity taking wagers from punters and in exchange receiving a guaranteed fee and no financial exposures to the event's outcome when taking wagers using the odds generated by a third party odds maker as distributed by a licensed odds disseminator. And in yet another embodiment, a hybrid wagering system is presented that incorporates traditional fixed odds wagering within a pari-mutuel wagering framework.

BRIEF DESCRIPTION OF THE DRAWINGS

The features, advantages, and objects of embodiments of the present invention will become more apparent from the detailed description as set forth below, when taken in conjunction with the drawings in which like referenced characters identify correspondingly throughout, and wherein.

DETAILED DESCRIPTION

Figure 1:
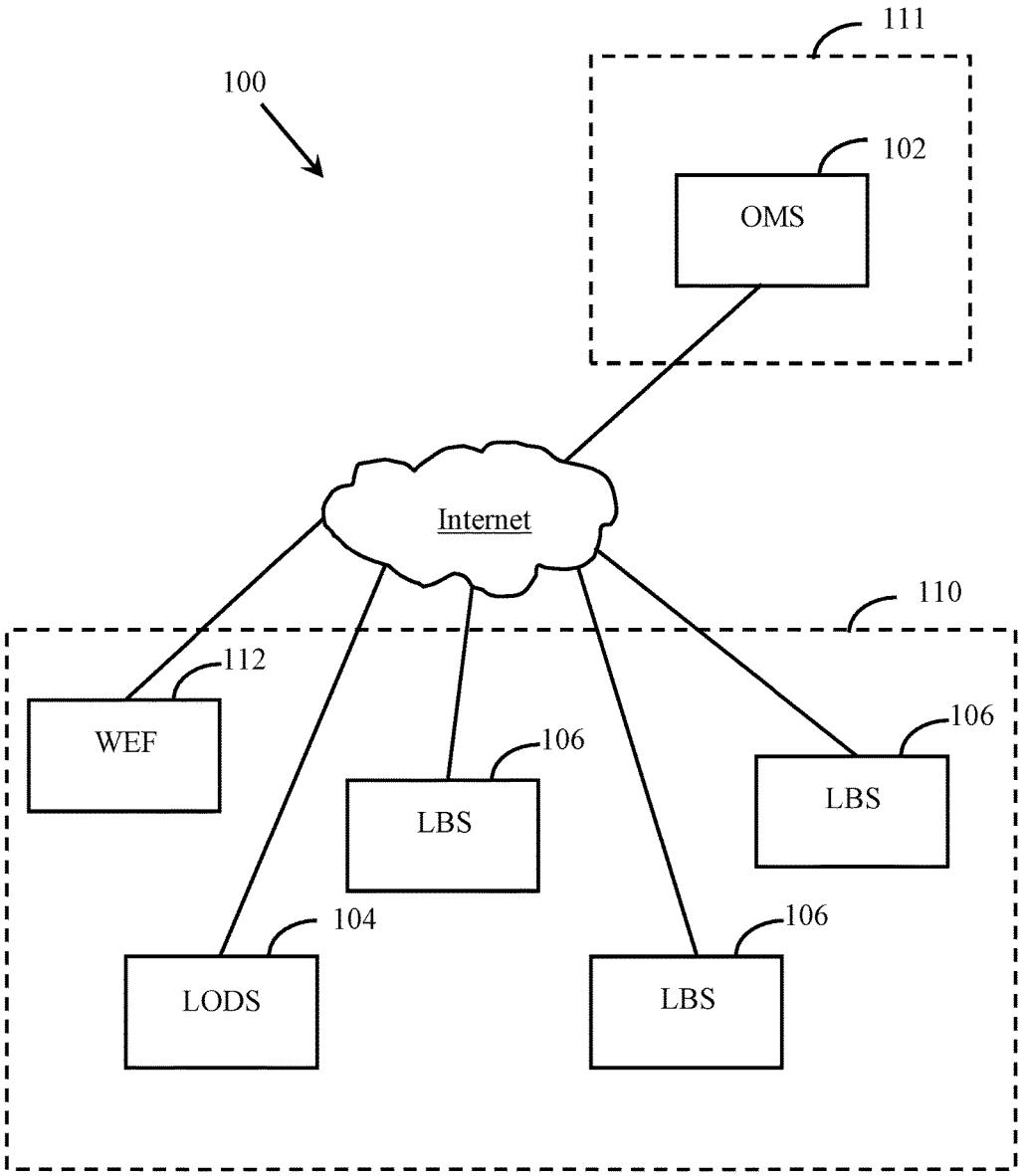
FIG. 1 is an overview diagram illustrating one embodiment of a networked wagering ecosystem.

Embodiments of the present invention comprise a networked wagering ecosystem across multiple jurisdictions, such that the servers of an Odds Management System ("OMS") in one jurisdiction sends, over a communication network, wagering odds on substantially real-time basis to a Licensed Odds Disseminator server ("LODS") who in turn distributes the odds to a Licensed Book ("LB"), both of whom are licensed to do business within a particular jurisdiction, wherein LB is an entity that accepts wagers from punters ("P). Overall, embodiments of the invention address the existing challenges, especially for time-sensitive InPlay wagers, that licensed wagering entities face for not having regulatory approval to interface their systems with unlicensed entities, and directly use odds calculated by those unlicensed entities. Embodiments of the invention provide an efficient marketplace for providing wagering odds that are legally complaint in one jurisdiction to entities located in other jurisdictions. Described herein is a technical interactivity and interoperability between a licensed entity's system and an unlicensed odds maker's system and also addresses the technology challenges of sorting through large amounts of data facing a Business-to-Consumer ("B2C") entity to identify the best odds and the bet sizes offered by third party odds providers.

Before describing the embodiments in more detail, it should be noted that the wagering industry in the U.S. started by Nevada casinos providing B2C wagering services. Nevada casinos usually use internally-generated odds and have a goal of minimizing their risks as much as possible. Risk is managed by changing the odds that they offer to punters as wagers are placed, and putting wagering limits or "caps" on wagers. Over the years, Nevada casinos have developed various types of fixed odds wagering formats. Overall, the principle of fixed odds wagering is that at the time a wager is placed, the exact payout amount is established should the wager result in a win. Fixed odds can be offered in different styles, such as straight bets, parlays, totals, money lines, spreads, propositions, teasers, if bets, etc. Also, some types of wagers may have different names, for example straight bets may be called head-to-head bets and totals might be called over and under. Regardless of the types of wagers offered, one can generally put them into three broad categories. The first category includes those that are based on a probability factor, which may be presented in different formats. However, regardless of the way they are offered, they can be translated to a probability percentage of something happening, e.g. a probability of team A prevailing over team B or a probability of a number of teams winning during a tournament as in a parlay wager.

Another category of wagers use handicap points. For example, if in a football game, team A is favorite to win over team B by 10 points, bookmakers may level off the probability factor to 50/50 by giving one team a handicap point. These types of wagers are called spread betting whereby the favorite team must win by a spread of points, e.g. by 10 points.

Another category of betting on an outcome is binary i.e. something will either happen or not happen. Examples of binary wagering is to bet whether player X scores the first goal or not, or whether a stock price of company Y will close above $100 on a specific date. The premise behind these types of wagers is that the underlying event upon which they are based either will happen or will not happen. Regardless of how a wager is presented, one can translate the odds of a binary event to a probability factor and also calculate an expected payoff based on the event's probability and a fee charged by an operator for facilitating the wager.

It should also be noted that the embodiments described herein could be applied to almost any type of wagering event, although the examples described below cover only one or two types of wagers.

In summary, embodiments of the invention introduce technological solutions that address challenges facing the wagering industry such as compliance with regulatory requirements when accepting wagers from consumers and being restricted from having business relationships and technology interactivity with unlicensed entities in the jurisdiction. The primary reasons behind regulatory requirements are to protect consumers as well as to ensure compliance with taxation requirements. Embodiments of the invention create a technology buffer between licensed Business-to-Consumer ("B2C") entities that offer wagers to punters, and licensed entities that consolidate and disseminate their own and third party-generated odds, while facilitating interactions between Business-to-Business ("B2B") and licensed B2C entities to create a technology solution to regulatory requirements. Overall, the business model of gaming companies is to offer games that have a house edge, receive a fee for facilitating a wager, or taking a rake for offering a game that has no house edge, for example, for games that the house acts as a facilitator, such as in poker games offered inside a casino or a card club. Embodiments of the present invention also create new business opportunities for risk-averse gaming entities that avoid covering a wide range of games or do not offer an extensive number of InPlay wagers. It should also be noted that during the below examples, when reference is made to a game or an event, it may apply to fantasy games based on fantasy teams as played in fantasy sports such as DFS or any future event where an outcome is uncertain.

FIG. 1 illustrates one embodiment of a networked wagering ecosystem 100 comprising an Odds Management Server ("OMS") 102 associated with an Odds Management Service located and licensed to do business in jurisdiction 111, sending feeds of odds and bet limits of future events to a Licensed Odds Disseminator Server ("LODS") 104 associated with a Licensed Odds Disseminator service within a regulated gaming market 110, such as the state of Nevada. OMS 102 generates odds for a variety of events, including InPlay and pre-play events associated with, for example, sporting events. OMS 102 may generate these odds based on user input, i.e., management of OMS 102, and/or autonomously, for example by a processor programmed with Artificial Intelligence, such as IBM's Watson. Initial odds may be set using detailed data, statistics and historical information about past events related to the future events, such as player statistics, team statistics, etc.

LODS 104 disseminates the odds and bet limits associated with future events received from OMS 102 to one or more Licensed Book Servers ("LBS") 106 associated with a licensed gaming entity such as a casino licensed to take wagers in regulated market 110, who in turn offers wagering opportunities to their customers (known as "punters" (P) 108). Each LBS 106 provides a description of each event and the odds and wagering limits associated with each event to the punters, and the punters may place wagers on one or more future events, based on the odds and betting limits. LBS 104 may also provide odds and betting limits to Wagering Entity Fund server ("WEF") 112 associated with a Wagering Entity Fund. Wagers placed by P 108 and WEF 112 with LBS 106 are reported to LODS 104, which then reports them to OMS 102 for risk management purposes and consideration as to whether OMS 102 should change the odds and the bet limits associated with the event, based on wagers placed by punters in one or more LBSs 106 and WEF 112. The totality of wagers received from a plurality of LBSs 106 and/or WEFs 112 of a future event forms a book of OMS 102 and the goal of OMS 102 is to balance the book for each defined future event to limit losses to management of OMS 102 in case the book becomes imbalanced, based on all of the wagers received, including wagers placed by punters in jurisdiction 111 and received by OMS 102. In one embodiment, another OMS 102 provides odds and betting limits directly to WEF 112 or to LBS 106.

It should be understood that although only three LBSs 106 and one LODS 104 is shown in jurisdiction 110, in practice, there is typically many tens or hundreds of LBSs and several LODSs 104 operating in jurisdiction 110. Further, although FIG. 1 shows LODS 104 and each LBS 106 communicating with each other via the wide-area network, in other embodiments, one or more LBSs 106 may communicate directly with an LODS 104, for example over a local-area network or via some other network other than the wide-area network.

Each OMSs 102 is located outside regulated gaming market 110, while LODS 104 and LBS 106 is located within regulated gaming market 110. LODS 104 may calculate and distribute its own odds relating to an event and offer these odds, as well as the odds provided by OMS 102, to LBS 106 and/or WEF 112. OMS 102 may also provide similar services to other jurisdictions 110.

System 100 allows LBS 106 to offer wagering opportunities to its punters that it normally would not, or could not, due to a lack of liquidity that certain wagering opportunities would present. For example, if management of a casino operating LBS 106 wanted to offer a wagering opportunity for punters to place wagers on an "obscure" event, such as the outcome of a soccer game in Chile, it might find that it receives bets from only a few punters. In that event, the chances that the book would be imbalanced is high, meaning, for example, that LBS 106 might receive wagers of $1,000 that soccer team A will win, while receiving wagers of $10,000 that soccer team B will win. This imbalance would normally open management of LBS 106 to a risk that Team B would win, resulting in a large loss to management of LBS 106. System 100 eliminates this risk and shifts it to management of OMS 102, who is better able to tolerate imbalances from a single LBS 106, as OMS 102 receives wagers from many other LBS 106's located in gaming market 110, as well as other wagering/gaming markets. OMS 102 provides odds of certain future events normally unavailable to LBS 106, or on events where LBS 106 may risk low liquidity (i.e., for InPlay wagers, or foreign-based wagers), and LBS 106 offers these wagering opportunities to its customers (i.e., punters), in exchange for a guaranteed fee from OMS 102.

In one embodiment, the odds and betting limits for a variety of wagering opportunities received by LODS 104 from one or more OMSs 102 is organized, for example, by odds and/or by betting limits, and then LODS 104 makes the organized data available to one or more LBSs 106 and/or WEFs 112 within a jurisdiction where LODS 104 is located. OMS 102 may transmit the odds and bet limits to LODS 104 via a web feed, such as RSS or similar technology that provides frequently-updated data content securely to LODS 104 to either be relayed to LBS 106 or stored along with the data received from other OMSs 102 in a memory or database. If the data is stored in a database, LODS 104 may sort it by game/event, by wagering odds and/or by bet limits and relay the sorted data to LBS 106 for selection and offering to a plurality of punters. The data provided to LBSs 106 may additionally comprise an indication of a credit to one or more of the LBSs 106 for using the wagering odds provided by LODS 104 as a guaranteed fee for LBS 106 offering wagering opportunities to punters based on the wagering odds provided by OMS 102. Similar to quotes made by a stock exchange such as NADSAQ, OMS 102 creates a vigorous marketplace for LBSs 106, via LODS 104, to offer new wagering opportunities in their jurisdiction to punters based on wagering odds provided by one or more OMSs 102 located outside of the jurisdiction that the LBSs 106 are located.

It should be noted that LBS 106 and WEF 112 could be the same entity, i.e. an entity licensed to take wagers and willing to take risks, generate its own odds or purchase odds from LODS 104.

Figure 2:
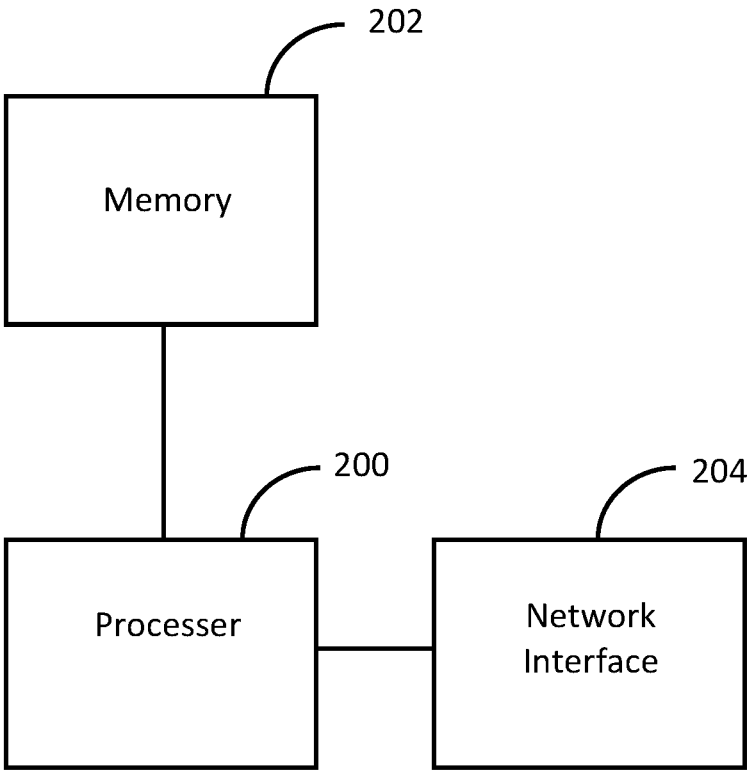
FIG. 2 is a functional block diagram of one embodiment of the LBS shown in FIG. 1 comprising processor 200, memory 202, and network interface 202.

FIG. 2 is a functional block diagram of one embodiment of LBS 106 comprising processor 200, memory 202, and network interface 202. It should be understood that OMS 102, LODS 104 and WEF 112 comprise the same or similar functional components.

Processor 200 is configured to provide general operation of LBS 106 by executing processor-executable instructions stored in memory 202, for example, executable code. Processor 200 typically comprises a general purpose processor, such as an i5 processor manufactured by Intel Corporation of Santa Clara, Calif., although any one of a variety of microprocessors, microcomputers, and/or microcontrollers may be used alternatively.

Memory 202 comprises one or more information storage devices, such as RAM, ROM, EEPROM, UVPROM, flash memory, SD memory, XD memory, or other type of electronic, optical, or mechanical memory device. Memory 202 is used to store processor-executable instructions for operation of LBS 106, as well as any information used by processor 200 to offer new wagering opportunities to punters, such as real-time, in-game bets and bets relating to events occurring in jurisdictions other than where the an LBS 106 is located, such as wagering odds provided by LODS 104 and/or OMS 102, one or more books, each relating to a particular wagering opportunity, punter account information, account balances, etc.

Network interface 202 comprises circuitry necessary for processor 200 to communicate over one or more networks, such as the Internet and/or one or more local-area networks. Such circuitry is well known in the art.

Figure 3A:
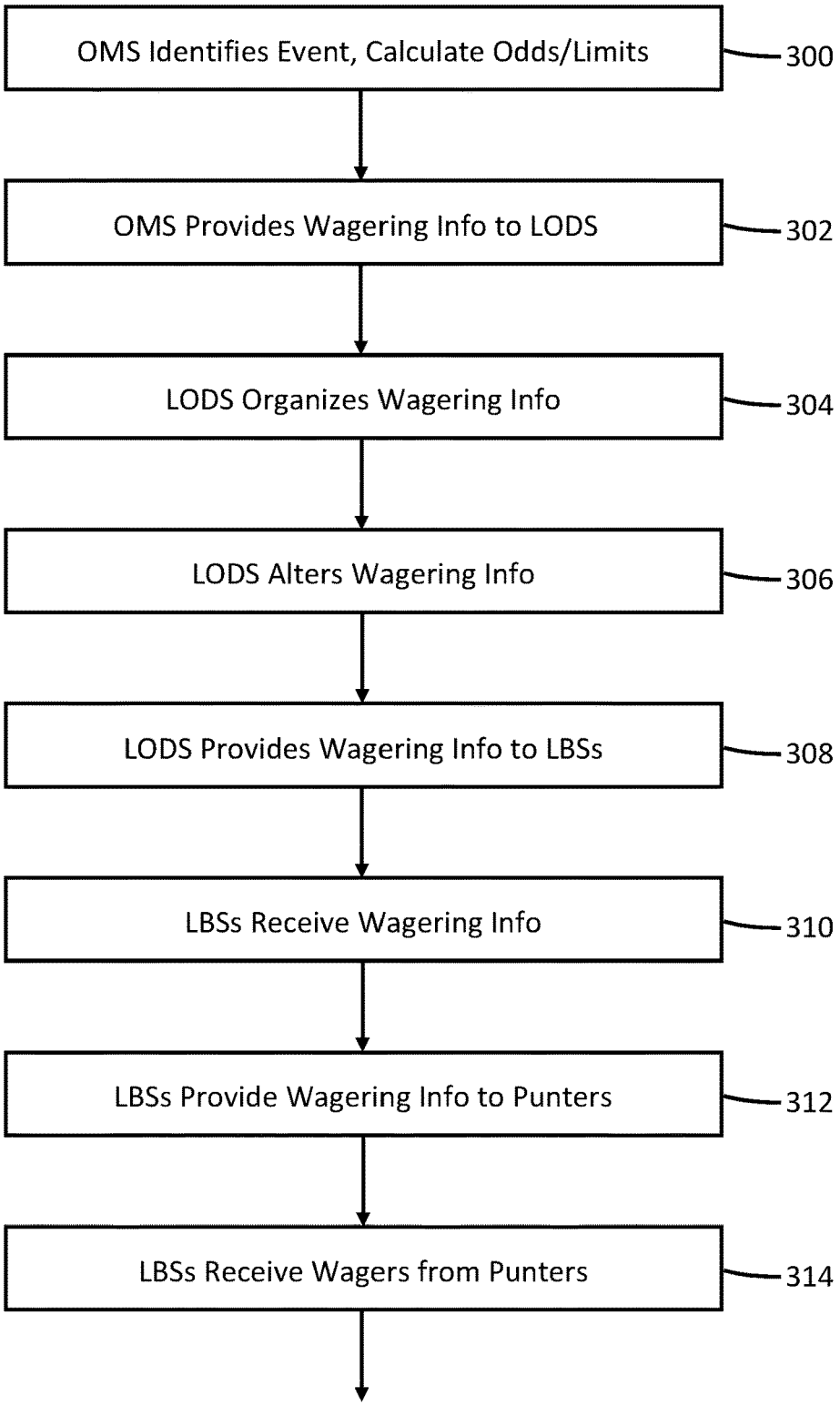
FIGS. 3A and 3B are flow diagrams illustrating one embodiment of a method for enabling the LBSs shown in FIG. 1, located in one jurisdiction to offer wagering opportunities based on future events that occur outside of the jurisdiction.
Figure 3B:
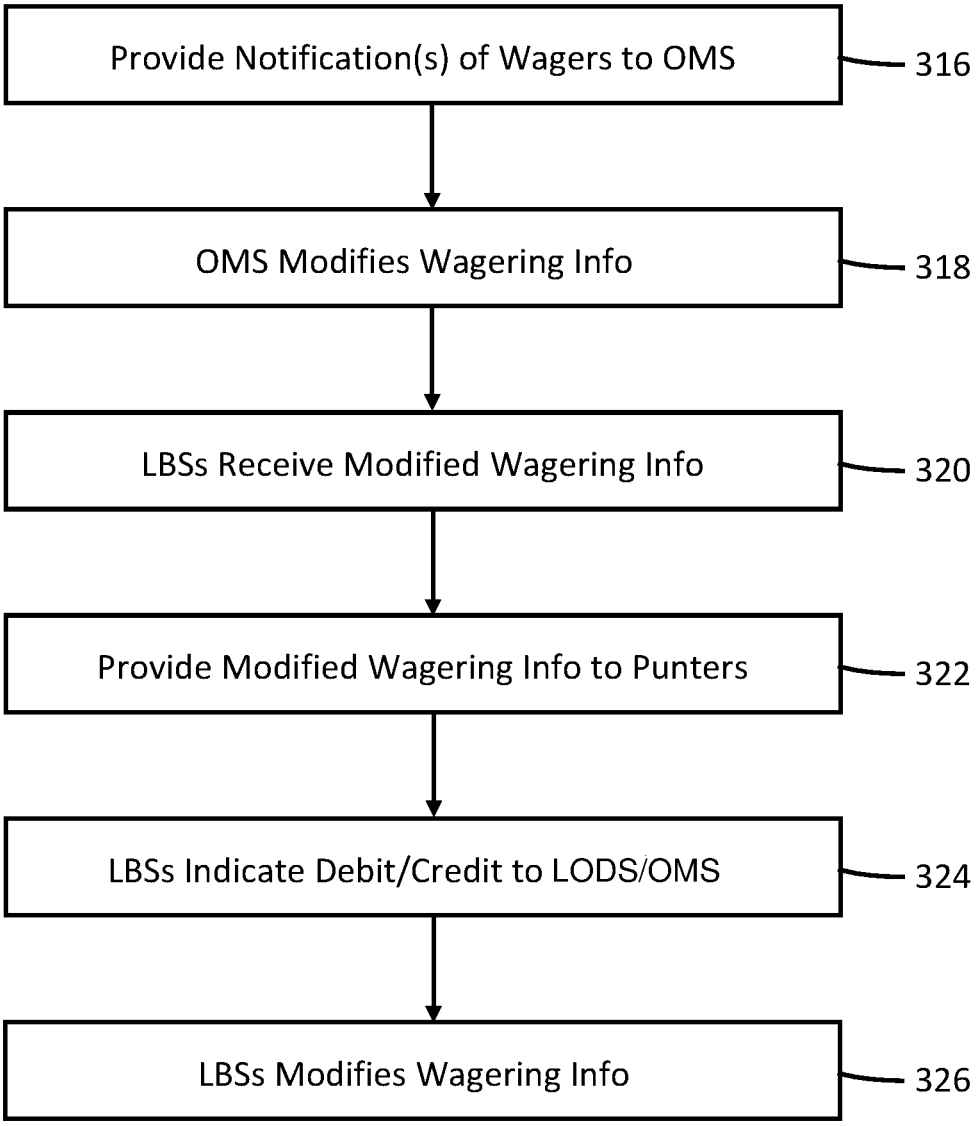

FIG. 3 is a flow diagram illustrating one embodiment of a method for enabling LBSs 106 located in one jurisdiction to offer wagering opportunities based on future events that occur outside of the jurisdiction or on any future event where LBS 106 is at risk for having an unbalanced book, such as InPlay events or "obscure" events, i.e., events not known by a vast majority of the gambling public. It should be understood that the steps described in this method could be performed in an order other than what is shown and discussed.

At block 300, OMS 102, located and licensed to do business in a first jurisdiction, identifies one or more future events and calculates wagering odds, wagering limits, end date/time for receiving wagers, or other information associated with each future event ("wagering information"). OMS 102 may identify events and calculate odds as provided by management of OMS 102, and/or it may perform these functions using artificial intelligence. The wagering information may additionally comprise a guaranteed fee to any LBS 106 who promotes the wagering opportunities to its punters located in a second jurisdiction, as will be explained below.

At block 302, OMS 102 provides an identification of the future event and the associated wagering odds and/or limits (the "wagering information") to LODS 104 via wide-area network, such as the Internet. LODS 104 is located and licensed to business in the second jurisdiction, but not the first jurisdiction. In another embodiment, OMS 102 provides the identification of the future event and associated wagering odds and/or limits directly to one or more LBSs 106.

At block 304, LODS 104 receives the wagering information associated with one or more future events, and may organize this information based on event, event type, event location, by odds, by wagering limit, etc. The information received from OMS 102 is typically stored in a memory or database associated with LODS 104.

At block 306, LODS 104 may alter the waging information provided by OMS 102. For example, LODS 104 may alter the wagering odds, wagering limits, etc. This may be performed automatically, by LODS 104 comparing the wagering information to one or more sets of pre-stored wagering information stored in an associated memory or database. For example, pre-stored wagering information may indicate that the maximum wagering limit for any wager is limited to $500. If a wagering limit received from OMS 102 is greater than this limit, LODS 104 may alter the limit received from OMS 102 to $500.

At block 308, LODS 104 provides the wagering information to one or more LBS 106, typically via the wide-area network, either in the original format as provided by OMS 102, sorted by LODS 104, and/or altered by LODS 104.

At block 310, LBS 106, located and licensed to do business in the second jurisdiction, but not in the first jurisdiction, receives the wagering information from LODS 104. The wagering information is provided to processor 200 via network interface 204. In some embodiments, the wagers include wagers tied to InPlay and pre-play events.

At block 312, processor 200 provides the wagering opportunities, including wagering odds and betting limits, to a plurality of punters. This may take the form of processor 200 updating a web page where wagering opportunities are offered to punters, and/or processor 200 may provide a signal to a display board located in one or more venues, such as casinos, where an indication of each future event may be displayed along with the wagering odds calculated by OMS 102 and/or LODS 104. Punters may place wagers on one or more of the future events, for example, online or by interacting with an agent of a venue, providing monetary value to the agent in exchange for a ticket, voucher or other proof that a wager was placed for a certain future event.

At block 314, processor 200 receives an indication via network interface 204 that one or more wagers have occurred, typically indicating an identification of a punter who placed the wager, a wager amount, an identification of the future event selected by the punter on which the wager is applicable, and/or the wagering odds. Processor 200 may store this information in memory 202.

At block 316, processor 200 may provide a notification of each wager that is received via network interface 204 to LODS 104 and/or directly to OMS 102 via the wide-area network, either as the wagers are received or at predetermined time intervals, such as every 15 minutes. The notifications may comprise an identification of LBS 106, a wager amount and an identification of the future event selected by the punter, or it may comprise, simply, a book maintained by LBS 106 regarding wagers placed on both sides of the bet for each particular wagering opportunity offered to punters. In one embodiment, the notifications are provided to LODS 104, and LODS 104 forwards the notifications to OMS 102. In one embodiment, LODS 104 may not report the wagers that can get consolidated, because their associate risks effectively offset each other. By balancing the risks associated with these wagers, LODS 104 can keep in-house the profit spreads pertinent to these wagers.

At block 318, either LODS 104 or OMS 102 may modify the wagering odds for the future event listed in a notification, based on the wagers placed by punters in the jurisdiction where LBS 106 is located, since OMS 102 is ultimately responsible for the risk of book imbalances of LBS 106 and other LBS 106's. For example, OMS 102 may provide original wagering odds regarding a future event to LODS 104 and then LODS 104 forwards the odds to LBS 106 as 2:1 that an outcome of the future event would favor outcome A vs. B. LBS 106 provides these odds to punters as explained above, and may receive $2000 in wagers that outcome A will occur, while only receiving $500 that outcome B will occur. These wagers are reported to LODS 104 and/or directly to OMS 102 to be included in OMS 102's overall risk management system serving multiple jurisdictions. In response to receiving the wager information from one or more LODSs 104 and/or one or more LBSs 106, OMS 102 may modify the odds in order to reduce a risk of loss due to an imbalance that may occur based on the totality of wager information received from all LBSs 106. For example, OMS 102 might modify the 2:1 odds to 4:1 in an attempt to balance its own book. The modified odds are then provided to any LBS 106 that is offering wagering opportunities of the future event associated with the odds change, either directly or via one or more LODSs 104. When processor 200 determines that a book related to a future events is out of balance by more than a predetermined amount, processor 200 may change the odds relating to the event in order to attempt to bring the book back in balance. The predetermined amount could comprise a percentage of the potential loss to OMS 102 or a potential dollar loss in the event that OMS 102 would have to pay out more than it received in wagers from multiple ones of the LBSs 106.

At block 320, the modified odds are received by processor 200 via network interface 204, either directly from OMS 102 or from LODS 104.

At block 322, processor 200 provides the modified wagering odds for the future event to punters via network interface 204. Thereafter, LBS 106 receives wagers for the future event from punters based on the modified wagering odds.

At block 324, LBS 106 may provide a debit or a credit to OMS 102 or LODS 104 based on contractually-guaranteed fees provided from OMS 102 or LODS 104 to LBS 106 for LBS 106 using the wagering odds provided by OMS 102 or LODS 104 and based on the payouts by LBS 106 to punters who won wagers on the future event.

For example, LBS 106 may receive wagering odds of a future event from LODS 104 when LODS 104 receives the wagering odds from OMS 102, where OMS 102 is located outside the jurisdiction where LODS 104 and LBS 106 are located. The owners of OMS 102 or LODS 104 may be contractually obligated to provide LBS 106 a guaranteed fee in exchange for promoting betting on future events occurring outside the jurisdiction where LODS 104 or LBS 106 are located. In one embodiment, a guaranteed fee might comprise a fixed percentage of all wagers received by LBS 106 for each future event promoted to punters by LBS 106, such as 2%.

In one example, if a future event comprises a sporting event played by teams A and B against each other, OMS 102 or LODS 104 may provide wagering odds to LBS 106 that team A is favored to win against team B by 10 points. LBS 106 promotes this event and the wagering odds provided from either OMS 102 and/or LODS 104 to punters and receives $11,000 in wagers for team A to win and $5,500 in wagers for team B to win, i.e. LBS 106 receives a total "handle" of $16,500. If team A wins, then LBS 106 must provide a payout to winning punters who wagered on team A in the amount of $20,000, according to a traditional business model of betting $11 to win $10. This results in a net loss to LBS 106 of $3,500 ($16,500 received and $20,000 paid out). In this example, LBS 106 determines the net profit or loss after game has concluded, and provides a notification to LODS 104 or OMS 102 of the net loss or profit. In this case, LBS 104 notifies OMS 102 and/or LODS 104 of the $3,500 cash flow shortfall ($20,000 in winner payouts less $16,500 in total wagers received, and adds the guaranteed fee of $330 ($16,500×2%) to the amount that LODS has to compensate LBS for this event. LODS 104 or OMS 102, in turn, provides LBS 106 a credit in the amount reported by LBS 106. LBS 106 may report such profits, losses and fees for a specified period, such as a week or a month, and LODS 104 or OMS 102 may settle with each other at these time intervals or some other time interval. Moreover, a similar arrangement may be in place between LODS 104 and OMS 102, where OMS 102 provides a guaranteed fee to LODS 104 for LODS 104 distributing the wagering odds from OMS 102 to LBSs 106 in LODS 104's jurisdiction. In this case, LODS 104 reports to OMS 102 the results of all wagers placed by all LBSs 106 that used the wagering odds from OMS 102.

Continuing with the example above, if $5,500 was wagered on team A and $11,000 was wagered on team B, and team A won, then LBS 106 would have to pay $10,000 to the winners which, when subtracted from the total handle of $16,500, results in a net profit of $6,500 to LBS 106, plus the guaranteed fee of $330. LBS 106, then, would report a credit to LODS 104 or OMS 102 of either the grand total of $6,170 ($6,500 less $330) or it would provide the net profit and guaranteed fee separately. Assuming that LODS 104 makes 1% on all wagers from OMS 102 for wagers placed through multiple LBSs 106*s* who received the wagering odds from LODS 104, the settlement between OMS 102 and LODS 104 will reflect the accounting between LODS 104 and all LBS 106 entities that took wagers from punters based on the guaranteed fee arrangements. It should be noted that the fee percentages may vary. For example InPlay wagers may have a higher fee than pre-match wagers, and also the fee percentages may vary by game or by types of wagers.

At block 326, LBS 106 may decide to adjust the wagering odds or its fees with LODS 104 using LOD's Routing and Management System ("RMS"). The RMS system is an interface system that manages the feed of wagering information between LODS 104 and LBS 106 and manages other data such as wagers taken by each LBS 106. The decision to change the odds may be for marketing reasons to distinguish one LBS 106 from a competing, other LBS 106 who offer the same odds disseminated by LODS 104. Using the above example where team A is favorite to win over team B by 10 points, if LBS 106 changes the spread to 12 (from 10), and team A wins by 11 points, then LBS 106 would not have to pay punters who wagered on team A, because LBS 106 changed the spread. In such cases, LBS 106 keeps the profit on these wagers in-house without having to account to LODS 104 or OMS 102. Conversely, if LBS 106 changed the 10 point spread to 8 points, and team A won by 9 points, LBS 106 would lose on these wager and has to pay punters who bet on team A without getting compensated from LBS 106 because it changed the odds offered by LODS. In another embodiment, when LODS uses the odds from several OMS's for an event, the RMS may handle the routing of the event and odds selection from one or more OMS 102's to one or more LBS 106's. LODS 104 staff may use an administration terminal to access a database associated with LODS 104 and/or staff at LBS 106 may use an administration terminal to access the same database to select and order wagering odds for future events or upcoming sporting matches that LBS 106 is interested to offer to its punters P using the odds provisioning service offered by LODS 104/OMS 102. The RMS may also provide customization options for LBS 106 staff to adjust the wager odds and guaranteed fees by an amount such as one or more percentage points, to aid LBS 106 in distinguishing its offerings from other LBSs 106. Any modifications made are stored in the database associated with LODS 104. As an example, if fees associated with odds related to a tennis match and provided by LODS 104 to LBS 106 for InPlay wagers are 8%, LBS 106 may request to LODS 104 that the fee be increased an additional 2 percentage points, or 10%. Such modifications allow LBS 106 to have the flexibility to customize its own odds and fees around its business and marketing plans.

Figure 4:
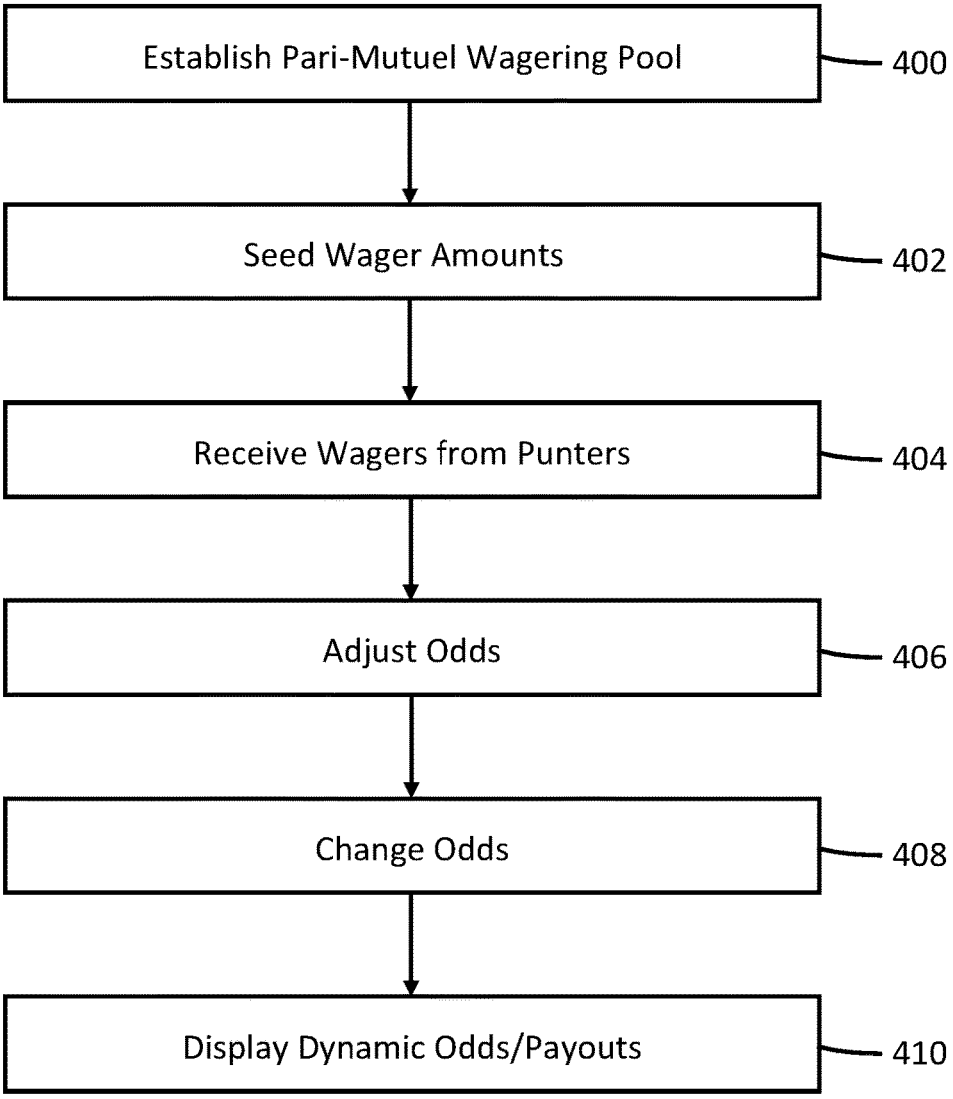
FIG. 4 is a flow diagram illustrating one embodiment of a method performed by the LBS or WEF shown in FIG. 1, acting as a wagering fund prepared to take risk, which may either get licensed as a book or cooperate with one or more existing books to offer "hybrid" wagering.

FIG. 4 is a flow diagram illustrating one embodiment of a method performed by LBS 106 or WEF 112, acting as a wagering fund prepared to take risk, which may either get licensed as a book or cooperate with one or more existing books to offer "hybrid" wagering, i.e. a combination of fixed odds and pari-mutuel wagering. In this embodiment, after paying fixed odds winners and fees associated with both the fixed odds and the pari-mutuel wagers, LBS 106 or WEF 112 distributes the remaining balance in a betting pool to winners proportional to their wagers. A hybrid-wagering framework allows punters who prefer fixed odds to participate in placing wagers on games with those who are participating in a pari-mutuel format. Having both fixed odds and pari-mutual stakeholders willing to take risk in one pool can create a bigger and more robust market than having a number of individual pools of fixed odds, with each entity trying to balance its own book. By using historical data and statistical analysis that generates odds with higher win probabilities and implementing arbitrage with other books, a wagering fund associated with WEF 112, for example, could take calculated risks and produce above average returns for its investors. This system and process of offering fixed odds within a pari-mutuel framework could create an attractive wagering venue for both average punters, who would prefer fixed odds, and also provide a robust market for those who are willing to take more risk and in return receive better returns. In one embodiment, one or more wagering funds willing to take more risk may guarantee the pari-mutuel participants a payout range if their wagers prevail. The model supports having different classes of pari-mutuel bettors which takes into account the general principle of those who take more risks have the potential for more rewards. It should be understood that the steps described in this method could be performed in an order other than what is shown and discussed. It should also be understood that although the following discussion references only WEF 112, the same principles could be applied to LBS 106. Finally, it should be understood that WEF 112 comprises the same functional components as LBS 106, shown in FIG. 3, and reference will be made to these components during the following discussion.

At block 400, WEF 112 may either by itself or in partnership with LBS 106, establish a pari-mutuel wagering pool for a game or an event in response to input from management of WEF 112 via network interface 204 or a user input device, such as a mouse/keyboard (not shown). In response, processor 200 provides a notice of wagering opportunities for the game or event to punters in a casino via network interface 204 and one or more displays located inside the casino. The notice includes fixed odds, as generated by LBS 106, WEF 112, LODS 104 or OMS 102, as well as an indication that a pari-mutual payout will also occur. Processor 200 may additionally create a data record for storage in memory 202 of the wagering pool to track wagers placed by punters on either side of the wager. Such a data record may comprise an identification of the game or event, initial wagering odds, total wagers placed on one side of the bet and total wagers for the other side of the bet. A wager size limit may also be determined by management and provided to processor 200, which includes the wager size limit in the data record. Finally, a risk amount may be defined as the maximum dollar amount a risk manager/management of a book or a fund would be willing to lose if the outcome of the event is unfavorable to a position that management could take in the outcome of the event.

At block 402, processor 200 may seed one of the total wager amounts stored in the data record with an amount that is based on a probability factor for the wining side that is either internally generated by processor 200, provided by management, or offered by a third party. As an example, processor 200 may receive from LODS 104 or OMS 102 wagering odds that team A is a 2-to-1 favorite to win against team B and, in response, processor 200 may seed the total wagers placed for team A, as stored in by the data record, in an amount of $50 and seed the total wagers for team B in an amount of $100. In another example, if the wagering odds comprise a point spread, and team A is favorite to win by 10 points against team B, each of the total wagers for each of team A and team B may be seeded with the same amount, e.g. $100. Seeding both sides maybe in line with the expected payoff including any fees or those offered by a traditional fixed odds bookmaker, for example, if team A wins by at least 10 points, an $11 wager on team A wins $21 which includes a $1 fee for the bookmaker.

At block 404, processor 200 begins receiving wagers from punters via network interface 204. As the wagers are received, they are stored in memory 202.

At block 406, processor 200 may perform an adjustment of the odds, maximum wager allowed, and/or place a wager on one side if the pari-mutuel pool starts to become imbalanced. The adjustment may be performed automatically, by evaluating the wagers placed on both sides of the bet and determining when one balance is greater than the other balance by a predetermined amount and comparing the imbalance with criteria stored in memory 202, such as the maximum risk limit, or a stored ratio of one side of the bet vs. the other, or some other factor that indicates that the pool has become unbalanced, meaning that the wagers placed are not in proportion to expected wagers based on the odds provided to the punters.

As an example, if the wagering odds are 2-to-1 in favor of team A beating team B, and the maximum risk limit is defined as $50,000, processor 200 may begin reducing a wager size limit that punters may place on a sliding scale on one side of the bet, reduce the maximum wager limit and/or place a bet on one side or the other, either through an automated (via processor 200) or a manual (i.e., management) process, if one side of the bet moves away more than a pre-established threshold from the 2-to-1 probability factor. Each time the thresholds are hit, processor 200 automatically makes an adjustment or sends an alert to an operator to provide input to processor 200 for processor 200 to make an adjustment. By the way of an example, one may expect that given odds of 2-to-1 in the above example, if $100,000 is wagered on team A to win, the wagers for team B should be roughly $50,000. However, when the total wagered amount on team B is $80,000 and on team A is $100,000, and the wagering odds remain at 2-to-1, management of WEF 112 could have a $60,000 loss in the event that Team B wins (Total take=$180,000, less (2:1 payout to wagers placed on team B=$160 k plus return of wagers to punters who placed wagers on team B=$80 k)). To bring the wagers in line with the odds of the event, in one embodiment, processor 200 determines the exposure or amount that management of WEF 112 could lose, based on the wagers placed, and "wagers" $30,000 on team A to win and, in one embodiment, change the wagering limits that a punter can place on the event, for example, new wagering odds of 1.25:1 that team A will beat team B, which is in conformance with actual wagers received by processor 200 when the wagering odds were at 2:1. In other embodiments, processor 200 reduces the maximum bet allowed for team A or reduces the odds from 2:1 to something less.

At block 408, after setting up the pool (i.e., generating a wagering record of the event for storage memory 202 and promoting the event to punters), the odds of an event may change. For example, a key player may become injured, or OMS 102 and/or LODS 104 modify the odds based on wagers received. In this case, processor 200 calculates new odds based on a changed circumstance, may suspend accepting new wagers from punters and/or may start a new pool using the modified odds, and then provides the changed odds to punters.

In one embodiment, processor 200 may guarantee a minimum or a range of payouts if a wager prevails. In such situations, any monetary deficiencies have to be covered by the risk dollars set aside associated with the odds offered for the event. If the system offers these types of guarantees then the hybrid system has to be more sensitive to the wager limits and adjust them more frequently. In one embodiment, one or more pari-mutual participants e.g. WE 112 may take the most risks and guarantee a range of payouts for the other pari-mutuel participants if their wager prevails. For example if the probability of a team winning is 2 to 1, the payout to a class of pari-mutuel participants may range between 3/2 to 1 and 3 to 1 if their wager wins. In such cases, those taking the most risk, for example WE 112 will stand to receive the most rewards by sweeping the remaining balance in certain circumstances, which might translate to a higher payout e.g. 5 to 1.

At block 410, during the open period prior to the event, when processor 200 permits wagering on the event, processor 200 may dynamically display the odds or payoffs for a pari-mutuel bettor based on the current status of wagers placed. Once the event is finished and the results are established at block 410, i.e., processor 200 receives an indication via communication interface 204 of a result of the event, processor 200 provides a credit to the fixed odds winners in accordance with the odds when the winners placed their wagers, as well as fees due to WEF 112, i.e., as a fixed percentage of the total pool for hosting the pool, before processor 200 provides credit to the pari-mutuel winners. Processor 200 credits winners by sending payout information based on the wagers and the odds when the wagers were placed, as retrieved from memory 202, to one or more network-based terminals inside a venue where the bets were placed or over a wide-area network to online winners.

By offering hybrid wagers, i.e. a blend of fixed odds and pari-mutuel wagering, together with an interactive market and competitive odds for wagering on sports and uncertain future events, allows entities such as WEF 112 to act as an investment fund for investors that are willing to participate in high-risk and high-reward transactions that a traditional licensed bookmaker, whose primarily goal is to mitigate risks and balance it book, shies away from.

While the foregoing disclosure shows illustrative embodiments of the invention, it should be noted that various changes and modifications could be made herein without departing from the scope of the invention as defined by the appended claims. The functions, steps and/or actions of the claims in accordance with the embodiments of the invention described herein need not be performed in any particular order. Descriptions and abbreviations used herein are provided for ease of discussion only. After reading the description herein, it will become apparent to one of ordinary skill in the art that the present invention can be implemented in any of a number of different computing and networking environments.

I claim:

1. A multi jurisdictional wagering system comprising:

one or more licensed book servers ("LBS") located in a first jurisdiction for receiving wagering odds for a variety of future events from a licensed odds disseminator server ("LODS") located in the first jurisdiction, for offering the wagering odds to punters, for receiving wagers from the punters based on the wagering odds, and for providing notifications of the wagers to the LODS;

the LODS for receiving the notifications of the wagers from the LBS, for providing the notifications of the wagers to an odds management server ("OMS") located in a second jurisdiction, for receiving the wagering odds from the OMS, for distributing the wagering odds to the one or more LBSs; and the OMS for calculating the wagering odds, for providing the wagering odds to the LODS, and for modifying the wagering odds for the event based on the notifications of the wagers.

2. The multi jurisdictional wagering system of claim 1, wherein the future events comprises one or more of a sporting event, a race, fluctuations in financial instruments, or a future action whose outcome is uncertain.

3. The multi jurisdictional wagering system of claim 1, wherein the LODS is licensed by the first jurisdiction to disseminate the wagering odds, the LBS is licensed by the first jurisdiction to accept wagers from the punters within the first jurisdiction, and the OMS is licensed by the second jurisdiction to calculate odds for the future events.

4. The multi jurisdictional wagering system of claim 1, wherein the one or more LBSs modifies the wagering odds received from the LODS, and provides the modified wagering odds to the punters.

5. The multi jurisdictional wagering system of claim 1, wherein the OMS changes the odds of the event in response to the notifications of the wagers when the OMS determines that a book of at least one of the one or more LBS is out of balance.

6. The multi jurisdictional wagering system of claim 1, wherein the OMS provides a guaranteed fee to the one or more LBSs for using the wagering odds provided by the OMS.

7. The multi jurisdictional wagering system of claim 1, wherein the LODS provides a guaranteed fee to the one or more LBSs for using the wagering odds provided by the LODS.

8. The multi jurisdictional wagering system of claim 1, wherein the OMS provides a credit to the LODS for any loss incurred by any of the one or more LBSs, and the LODS provides the credit to any of the one or more LBSs that incurred a loss.

9. The multi jurisdictional wagering system of claim 1, wherein the LODS provides a credit to the OMS in an amount equal to any wagering gains reported to the LODS by any of the one or more LBSs, and any of the one or more LBSs who reported a wagering gain the LODS provides a credit to the LODS in the amount of the wagering gain.

10. A method performed by a licensed book server ("LBS") located in a first jurisdiction for offering wagering opportunities related to future events occurring outside the first jurisdiction, the method comprising:

receiving, by a processor via a communication interface, wagering odds related to one or more future events occurring outside the first jurisdiction;

providing, by the processor via the communication interface, the wagering odds to a plurality of punters;

receiving, by the processor via the communication interface, wagers from at least some of the punters related to a first of the one or more future events;

providing, by the processor via the communication interface, notifications of the wagers related to the first future event to a third party;

receiving, by the processor via the communication interface, modified wagering odds from the third party in response to providing the notifications of wagers related to the first future event; and providing, by the processor via the communication interface, the modified wagering odds to the plurality of punters.

11. The method of claim 10, wherein the future events comprises one or more of a sporting event, a race, fluctuations in financial instruments, or a future action whose outcome is uncertain.

12. The method of 10, wherein the processor receives, via the communication interface, the wagering odds from a licensed odds disseminator server ("LODS") located within the first jurisdiction.

13. The method of claim 10, wherein the processor receives, via the communication interface, the wagering odds from an odds management server ("OMS") located outside the first jurisdiction.

14. The method of claim 10, further comprising:

determining, by the processor, that a book relating to the wagers received related to the first future event is out of balance;

modifying, by the processor, the wagering odds when the processor determines that the book is out of balance; and providing the modified wagering odds to the punters.

15. The method of claim 10, wherein the OMS changes the odds of the event in response to the notifications of the wagers when the OMS determines that a book of the LBS is out of balance.

16. The method of claim 10, further comprising:

receiving a credit from the third party for using the wagering odds provided by the third party.

* * * * *